US011994027B2

(12) United States Patent
Chen et al.

(10) Patent No.: US 11,994,027 B2
(45) Date of Patent: May 28, 2024

(54) DENDRITIC REVERSE UNDERGROUND MINING METHOD FOR THIN COAL SEAM AT END SLOPE OF STRIP MINE

(71) Applicants: CHINA UNIVERSITY OF MINING AND TECHNOLOGY, Jiangsu (CN); JIANGSU VOCATIONAL INSTITUTE OF ARCHITECTURAL TECHNOLOGY, Jiangsu (CN)

(72) Inventors: Shuzhao Chen, Jiangsu (CN); Cangyan Xiao, Jiangsu (CN); Liu Han, Jiangsu (CN)

(73) Assignees: CHINA UNIVERSITY OF MINING AND TECHNOLOGY, Jiangsu (CN); JIANGSU VOCATIONAL INSTITUTE OF ARCHITECTURAL TECHNOLOGY, Jiangsu (CN)

( * ) Notice: Subject to any disclaimer, the term of this patent is extended or adjusted under 35 U.S.C. 154(b) by 146 days.

(21) Appl. No.: 17/565,432

(22) Filed: Dec. 29, 2021

(65) Prior Publication Data

US 2022/0243590 A1 Aug. 4, 2022

(30) Foreign Application Priority Data

Feb. 2, 2021 (CN) ..... 202110142210.4

(51) Int. Cl.

| | |
|---|---|
| ***E21C 41/18*** | (2006.01) |
| ***E21C 41/28*** | (2006.01) |
| ***E21F 15/00*** | (2006.01) |
| *E21F 13/06* | (2006.01) |

(52) U.S. Cl.

CPC ..... *E21C 41/18* (2013.01); *E21F 15/005* (2013.01); *E21C 41/28* (2013.01); *E21F 13/06* (2013.01)

(58) Field of Classification Search

CPC ..... E21C 41/18; E21C 41/28; E21F 15/005; E21F 13/06

See application file for complete search history.

(56) References Cited

U.S. PATENT DOCUMENTS 4,014,574 A * 3/1977 Todd ..... E21C 29/02 299/1.4
4,150,852 A * 4/1979 McCoy ..... E21C 41/28 299/18
4,480,872 A * 11/1984 Hawkins ..... E21C 47/02 299/56

* cited by examiner

*Primary Examiner* — Janine M Kreck
(74) *Attorney, Agent, or Firm* — JCIP GLOBAL INC.

(57) ABSTRACT

The present invention discloses a dendritic reverse underground mining method for a thin coal seam at an end slope of a strip mine. The method includes the following steps: step S1: using a continuous coal mining machine to excavate a main adit toward a boundary of the strip mine along a seam floor; step S2: excavating secondary adits on two sides of the main adit obliquely in a forward direction of the main adit; step S3: transporting the excavated coal out of the main adit by the self-moving belt conveyors; step S4: after the excavating of a secondary adit of the secondary adits is ended, withdrawing the continuous coal mining machine and the self-moving belt conveyor from the secondary adit, and then excavating subsequent secondary adits of the secondary adits in a similar way; step S5: filling the secondary adits, and filling a goaf of the main adit.

4 Claims, 4 Drawing Sheets

A-A

DENDRITIC REVERSE UNDERGROUND MINING METHOD FOR THIN COAL SEAM AT END SLOPE OF STRIP MINE

CROSS-REFERENCE TO RELATED APPLICATION

This application claims the priority benefit of China application serial no. 202110142210.4, filed on Feb. 2, 2021. The entirety of the above-mentioned patent application is hereby incorporated by reference herein and made a part of this specification.

TECHNICAL FIELD

The present invention specifically relates to a dendritic reverse underground mining method for a thin coal seam at an end slope of a strip mine, which belongs to the field of large-scale strip-mine coal mining.

BACKGROUND

Strip mining is an important method of coal mining in China, which has the advantages of high degrees of automation and integration, and is suitable for the application of modern management approaches. In China, the coal output produced by strip mining has exceeded 20% of the total annual coal output. Especially for the super-large strip mines in northwest China, the thickness of the main coal seam is up to 10 m or more, even 100 m, and the annual output of these strip mines is 3-100 times that of ordinary underground coal mines. However, in the mining process of large-scale strip mines, the recovery of unexploited coal at the end slope has always been an important factor affecting the coal mining rate of strip mines. Especially, the mining and recovery of the thin coal seams (less than 3.5 m thick) at the end slope of large-scale strip mines has been neglected for a long time due to the lack of mining methods, long mining cycle, high cost, low efficiency, and large impact on the normal production in strip mines, resulting in a great waste of coal resources.

In order to solve the above-mentioned problems and realize the economic mining and recovery of coal at the end slope without affecting the normal production in strip mines, the present invention proposes a method for coal mining at the end slope using the open-pit space of the strip mine and continuous mining equipment in the mine.

SUMMARY

In view of the above-mentioned problems in the prior art, an objective of the present invention is to provide a dendritic reverse underground mining method for a thin coal seam at an end slope of a strip mine, mainly to solve the problems of low efficiency and poor safety in the mining of unexploited coal at the end slope of large-scale strip mines in the prior art.

To achieve the above objective, the following technical solutions are adopted in the present invention.

A dendritic reverse underground mining method for a thin coal seam at an end slope of a strip mine, including development of a main adit, and arrangement of mining and transportation equipment, arrangement of secondary adits, coal mining and transportation, equipment relocation, post-mining filling, and blocking of the main adit, specifically including the following steps:

step S1: dividing unexploited coal at the end slope of the strip mine into a plurality of recovery mining areas every 80-100 m along an advancing direction of the strip mine; when a working slope of the strip mine advances to an end-slope thin coal seam during a mining process and an initial width of the end-slope thin coal seam exposed reaches 5 m, using a remotely controlled continuous coal mining machine to excavate the main adit starting from an exposed coal position at the end slope of the strip mine and toward a boundary of the strip mine along a seam floor, wherein the main adit has a semi-circular arch-shaped cross-section with a radius identical to an average thickness of the mined thin coal seam; arranging a belt conveyor with a movable crawler at a bottom, that is, a self-moving belt conveyor, in the main adit, wherein the self-moving belt conveyor is configured to transport raw coal mined during the excavating of the main adit out of the main adit;

step S2: when the excavating of the main adit reaches 40 m away from the boundary of the strip mine, stopping the excavating, and then continuing to excavate the secondary adits on two sides of the main adit obliquely in a forward direction of the main adit, wherein the secondary adits each are of a size and a shape identical to those of the main adit; when the excavating of each of the secondary adits reaches the boundary of the strip mine or a boundary of a respective one of the recovery mining areas, stopping the excavating, wherein openings of the secondary adits obliquely located on the two sides of the main adit are alternately arranged on the two sides of the main adit, a distance between centers of the openings of adjacent two of the secondary adits is 10-25 m, and as the excavating of the main adit advances, the distance between the centers of the openings of the adjacent two of the secondary adits gradually decreases, that is, the arrangement of the secondary adits becomes denser, and a set of a continuous coal mining machine and a self-moving belt conveyor is arranged independently in each of the secondary adits, and the self-moving belt conveyor in each of the secondary adits and the self-moving belt conveyor in the main adit are connected to each other;

step S3: remotely controlling the continuous coal mining machine to perform coal mining, transporting the excavated coal to the self-moving belt conveyor in the main adit by the self-moving belt conveyor in each of the secondary adits, and transporting the excavated coal out of the main adit by the self-moving belt conveyor in the main adit;

step S4: after the excavating of a first secondary adit of the secondary adits is ended, withdrawing the continuous coal mining machine and the self-moving belt conveyor from the first secondary adit, and subsequently excavating a next secondary adit of the secondary adits on a side of an opening of the first secondary adit close to an opening of the main adit, wherein on the two sides of the main adit, the secondary adits are alternately arranged on a left side and a right side, and subsequent secondary adits of the secondary adits are arranged in a similar way; and after the excavating of each of the secondary adits is ended, a tail of the self-moving belt conveyor in the main adit is retracted to shorten an overall length;

step S5: after the excavating of the main adit is completed, arranging a water/sand conveying system in the main adit; after the excavating of each of the secondary adits is ended and the continuous coal mining machine and the self-moving belt conveyor are withdrawn, transporting water/sand to each of the secondary adits by the water/sand conveying system to fill each of the secondary adits; water in the water/sand flowing back and converging into the main adit along each of the secondary adits and being pumped out by a pumping system in the main adit; meanwhile, filling a goaf of the main adit, and arranging a barrier wall for every 40-50 m of the main adit filled, to ensure that a filling material fills the goaf tightly and provides an effective support for a roof of the main adit, and meanwhile, to completely separate the filled goaf from a working area to enhance a safety of operation, wherein the secondary adits are alternately arranged to form a dendritic secondary adit arrangement, to realize the reverse mining of coal at the end slope, and residual coal pillars between the secondary adits are not mined, so as to ensure the stability;

step S6: when a strip-mine dumping platform advances to the opening of the main adit, gradually withdrawing the self-moving belt conveyor in the main adit as a whole from the main adit using the movable crawler at the bottom, instead of retracting the tail of the self-moving belt conveyor to reduce the overall length; determining that the excavating of unexploited coal in a recovery mining area of the recovery mining areas is completed, once the self-moving belt conveyor is completely withdrawn from the main adit; then building a concrete wall to block the opening of the main adit, and rapidly advancing the strip-mine dumping platform, to use a strip-mine overburden to strengthen coverage of the goaf to ensure stability of the end slope of the strip mine; and using the reverse underground mining method to mine a second mining area and a third mining area adjacent to a first mining area, to realize continuous recovery of the thin coal seam at the end slope in sequence.

Further, in the step S1, the main adit is inclined downward by 1-3° along the seam floor in an excavating direction.

Further, in the step S2, each of the secondary adits is inclined upward by 1-3° in an excavating direction.

Further, an angle between each of the secondary adits and the main adit in the step S2 is set to 45°-60°.

The present invention has the following beneficial effects. First, coal mining at the end slope is achieved through a dendritic adit arrangement, so that the coal output is improved, and meanwhile, the residual coal pillars and the backfill body are fully utilized to keep the roof stable, thereby ensuring the safety during production. Second, the reverse coal mining can realize the mining and filling at the same time, which further improves the stability of the coal mining area. Third, the construction and equipment relocation are in conjunction with the work of the mining site and the dumping site of the strip mine. Not only the normal production of the strip mine is not affected, but also the existing conditions are fully utilized to reduce the difficulty of construction and equipment relocation and reduce the project costs. In addition, coal resources are recovered by excavating, and the strength of coal seam and roof rock formations is fully utilized to achieve self-stability without requiring additional support.

Figure 1:
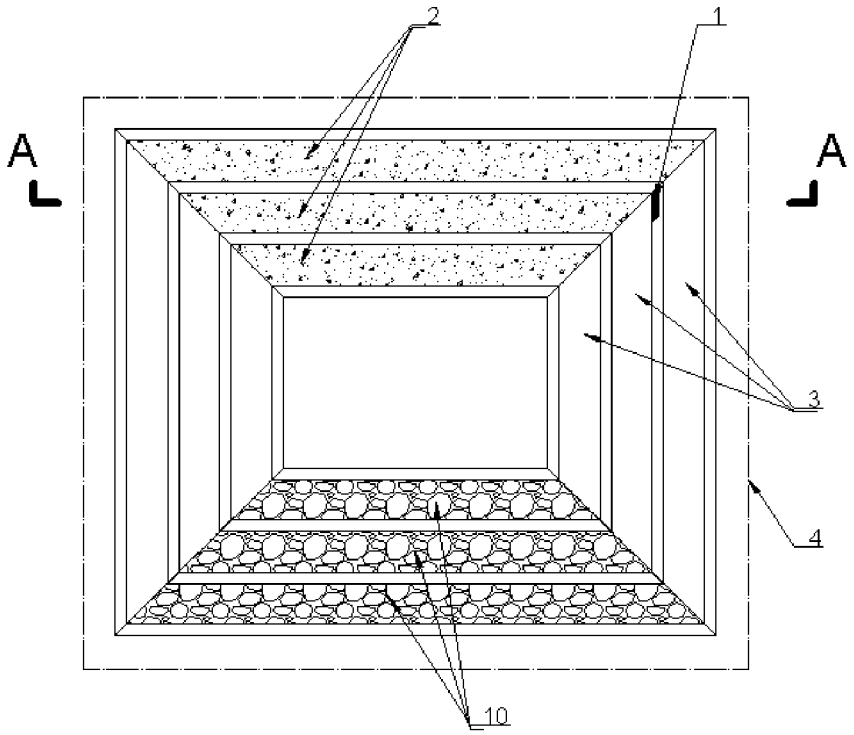
FIG. 1 is a top view of a mining site in a strip mine.

In the drawings: 1—end-slope thin coal seam, 2—working slope of strip mine, 3—end slope of strip mine, 4—boundary of strip mine, 5—main adit, 6—continuous coal mining machine, 7—self-moving belt conveyor, 8—secondary adit, 9—water/sand conveying system, 10—strip-mine dumping platform, 11—coal pillar, 12.1—first mining area, 12.2—second mining area, 12.3—third mining area, 13—boundary of recovery mining area.

DETAILED DESCRIPTION OF THE EMBODIMENTS

Hereinafter, the present invention is further described with reference to drawings.

Figure 2:
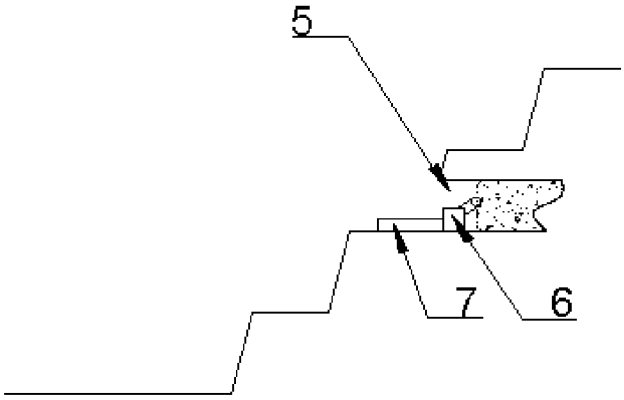
FIG. 2 is a cross-sectional view of an end-slope thin coal seam.
Figure 3:
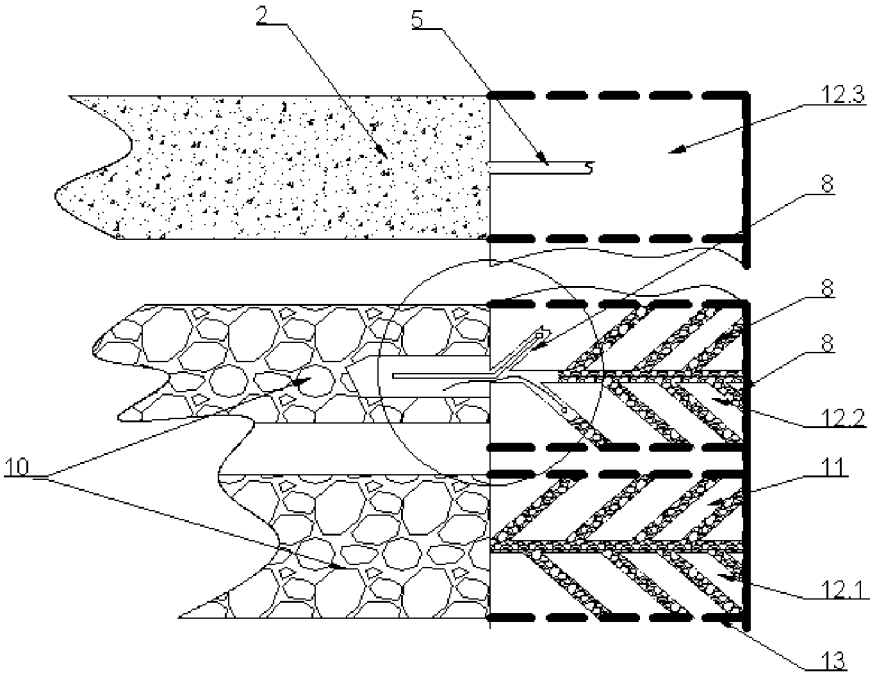
FIG. 3 is a layout diagram illustrating a dendritic reverse underground mining method for a thin coal seam at an end slope of a strip mine.
Figure 4:
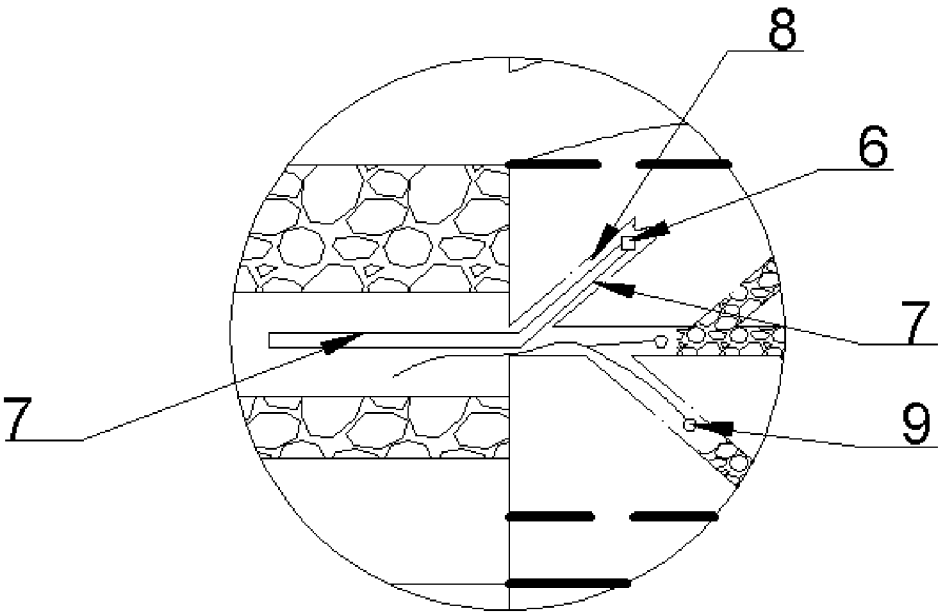
FIG. 4 is a partially enlarged view of the dendritic underground mining method.

As shown in FIG. 1 and FIG. 2, a dendritic reverse underground mining method for a thin coal seam at an end slope of a strip mine, including development of a main adit 5, and arrangement of mining and transportation equipment, arrangement of secondary adits 8, coal mining and transportation, equipment relocation, post-mining filling and blocking of the main adit 5, specifically including the following steps.

Step S1: Unexploited coal at the end slope of the strip mine is divided into a plurality of recovery mining areas every 80-100 m along the advancing direction of the strip mine. When the working slope 2 of the strip mine advances to an end-slope thin coal seam 1 during the mining process and the initial width of the end-slope thin coal seam 1 exposed reaches 5 m, a remotely controlled continuous coal mining machine 6 is used to excavate the main adit 5 starting from the exposed coal position at the end slope 3 of the strip mine and toward the boundary of the strip mine along the seam floor. The main adit 5 has a semi-circular arch-shaped cross-section with a radius identical to the average thickness of the mined thin coal seam. The main adit 5 is inclined downward by 1-3° along the seam floor in the excavating direction, so that water/sand can flow under gravity to prevent backflow. A belt conveyor with a movable crawler at the bottom, that is, a self-moving belt conveyor 7, is arranged in the main adit 5. The self-moving belt conveyor 7 is configured to transport raw coal mined during the excavating of the main adit out of the main adit 5.

Step S2: When the excavating of the main adit 5 reaches 40 m away from the boundary of the strip mine, the excavating is stopped, and then the secondary adits 8 are excavated on the two sides of the main adit 5 obliquely in the forward direction of the main adit. The secondary adits 8 each are of a size and a shape identical to those of the main adit 5. When the excavating of each of the secondary adits 8 reaches the boundary of the strip mine or a boundary 13 of a respective one of the recovery mining areas, the excavating is stopped. The secondary adit 8 is inclined upward by 1-3° along the excavating direction, so that water in the water/sand flows to the main adit under gravity and can be easily collected and pumped out.

The openings of the secondary adits 8 obliquely located on the two sides of the main adit 5 are alternately arranged on the two sides of the main adit 5, and the distance between the centers of the openings of adjacent two of the secondary adits 8 is 10-25 m. As the excavating of the main adit advances, the distance between the centers of the openings of the adjacent two of the secondary adits 8 gradually decreases, that is, the arrangement of the secondary adits 8 becomes denser. A set of a continuous coal mining machine 6 and a self-moving belt conveyor 7 is arranged independently in each of the secondary adits 8. The self-moving belt conveyor 7 in each of the secondary adits 8 and the self-moving belt conveyor 7 in the main adit 5 are connected to each other. The angle between each of the secondary adits 8 and the main adit 5 is set to 45°-60°. A too small angle is likely to cause stress concentration at the junction between the main adit 5 and the secondary adit 8, which damages the overall structural stability. A too large angle will reduce the length of the secondary adit 8, which affects the coal mining efficiency and makes it difficult to arrange and turn the equipment in the adit.

Step S3: The continuous coal mining machine 6 is remotely controlled to perform coal mining. The excavated coal is transported to the self-moving belt conveyor 7 in the main adit 5 by the self-moving belt conveyor 7 in each of the secondary adits 8, and then transported out of the main adit 5 by the self-moving belt conveyor 7 in the main adit 5.

Step S4: After the excavating of a first secondary adit 8 of the secondary adits 8 is ended, the continuous coal mining machine 6 and the self-moving belt conveyor 7 are withdrawn from the first secondary adit 8, and subsequently a next secondary adit 8 of the secondary adits 8 is excavated on a side of an opening of the first secondary adit 8 close to the opening of the main adit 5. On the two sides of the main adit 5, the secondary adits 8 are alternately arranged on the left and right sides, and the subsequent secondary adits 8 are arranged in a similar way. After the excavating of each secondary adit 8 is ended, the tail of the self-moving belt conveyor 7 in the main adit 5 is retracted to shorten the overall length.

Step S5: After the excavating of the main adit 5 is completed, a water/sand conveying system 9 is arranged in the main adit 5. After the excavating of each secondary adit 8 is ended and the continuous coal mining machine 6 and the self-moving belt conveyor 7 are withdrawn, water/sand is transported to the secondary adit 8 by the water/sand conveying system 9 to fill the secondary adit 8. Water in the water/sand flows back and converges into the main adit 5 along the secondary adit 9 and is pumped out by a pumping system in the main adit 5. At the same time, the goaf of the main adit 5 is filled, and a barrier wall is arranged for every 40-50 m of the main adit 5 filled, to ensure that the filling material fills the goaf tightly and provides effective support for the roof of the adit, and at the same time, to completely separate the filled goaf from the working area to enhance the safety of operation. The secondary adits 8 are alternately arranged to form a dendritic secondary adit 8 arrangement, to realize the reverse mining of coal at the end slope, and residual coal pillars 11 between the secondary adits 8 are not mined, so as to ensure the stability.

Step S6: When a strip-mine dumping platform 10 advances to the opening of the main adit 5, the self-moving belt conveyor 7 in the main adit 5 is gradually withdrawn as a whole from the main adit 5 using the crawler at the bottom, instead of retracting the tail of the belt conveyor 7 to reduce the overall length. It is determined that the excavating of unexploited coal in the recovery mining area is completed, once the self-moving belt conveyor 7 is completely withdrawn from the main adit 5. Then a concrete wall is built to block the opening of the main alit 5, and the strip-mine dumping platform 10 is rapidly advanced, to use the mine overburden to strengthen the coverage of the goaf to ensure the stability of the end slope of the strip mine. The reverse underground mining method is used to mine the second mining area 12.2, the third mining area 12.3, etc. adjacent to the first mining area 12.1, to realize the continuous recovery of the thin coal seam 1 at the end slope in sequence.

What is claimed is:

1. A dendritic reverse underground mining method for a thin coal seam at an end slope of a strip mine, comprising development of a main adit, and arrangement of a mining and a transportation equipment, arrangement of secondary adits, coal mining and transportation, equipment relocation, post-mining filling, and blocking of the main adit, specifically comprising the following steps:

step S1: dividing an unexploited coal at the end slope of the strip mine into a plurality of recovery mining areas every 80-100 m along an advancing direction of the strip mine; when a working slope of the strip mine advances to an end-slope thin coal seam during a mining process, and an initial width of the end-slope thin coal seam exposed reaches 5 m, using a remotely controlled continuous coal mining machine to excavate the main adit starting from an exposed coal position at the end slope of the strip mine and toward a boundary of the strip mine along a seam floor, wherein the main adit has a semi-circular arch-shaped cross-section with a radius identical to an average thickness of the mined thin coal seam; arranging a belt conveyor, that is, a self-moving belt conveyor, with a movable crawler at a bottom in the main adit, wherein the self-moving belt conveyor is configured to transport a raw coal mined during an excavating of the main adit out of the main adit;

step S2: when the excavating of the main adit reaches 40 m away from the boundary of the strip mine, stopping the excavating, and then continuing to excavate the secondary adits on two sides of the main adit obliquely in a forward direction of the main adit, wherein the secondary adits each are of a size and a shape identical to those of the main adit; when an excavating of each of the secondary adits reaches the boundary of the strip mine or a boundary of a respective one of the recovery mining areas, stopping the excavating, wherein openings of the secondary adits obliquely located on the two sides of the main adit are alternately arranged on the two sides of the main adit, a distance between centers of the openings of adjacent two of the secondary adits is 10-25 m, and as the excavating of the main adit advances, the distance between the centers of the openings of the adjacent two of the secondary adits gradually decreases, that is, the arrangement of the secondary adits becomes denser; and a set of a continuous coal mining machine and a self-moving belt conveyor is arranged independently in each of the secondary adits, and the self-moving belt conveyor in each of the secondary adits and the self-moving belt conveyor in the main adit are connected to each other;

step S3: remotely controlling the continuous coal mining machine to perform coal mining, transporting the excavated coal to the self-moving belt conveyor in the main adit by the self-moving belt conveyor in each of the secondary adits, and transporting the excavated coal out of the main adit by the self-moving belt conveyor in the main adit;

step S4: after an excavating of a first secondary adit of the secondary adits is ended, withdrawing the continuous coal mining machine and the self-moving belt conveyor from the first secondary adit, and subsequently excavating a next secondary adit of the secondary adits on a side of an opening of the first secondary adit close to an opening of the main adit, wherein on the two sides of the main adit, the secondary adits are alternately arranged on a left side and a right side, and subsequent secondary adits of the secondary adits are arranged in a similar way; and after the excavating of each of the secondary adits is ended, a tail of the self-moving belt conveyor in the main adit is retracted to shorten an overall length;

step S5: after the excavating of the main adit is completed, arranging a water/sand conveying system in the main adit; after the excavating of each of the secondary adits is ended and the continuous coal mining machine and the self-moving belt conveyor are withdrawn, transporting a water/sand to each of the secondary adits by the water/sand conveying system to fill each of the secondary adits; a water in the water/sand flowing back and converging into the main adit along each of the secondary adits and being pumped out by a pumping system in the main adit; meanwhile, filling a goaf of the main adit, and arranging a barrier wall for every 40-50 m of the main adit filled, to ensure that a filling material fills the goaf tightly and provides an effective support for a roof of the main adit, and meanwhile, to completely separate the filled goaf from a working area to enhance a safety of operation, wherein the secondary adits are alternately arranged to form a dendritic secondary adit arrangement, to realize a reverse mining of coal at the end slope, and residual coal pillars between the secondary adits are not mined, so as to ensure a stability; and step S6: when a strip-mine dumping platform advances to the opening of the main adit, gradually withdrawing the self-moving belt conveyor in the main adit as a whole from the main adit using the movable crawler at the bottom, instead of retracting the tail of the self-moving belt conveyor to reduce the overall length; determining that an excavating of unexploited coal in a recovery mining area of the recovery mining areas is completed, once the self-moving belt conveyor is completely withdrawn from the main adit; then building a concrete wall to block the opening of the main adit, and rapidly advancing the strip-mine dumping platform, to use a strip-mine overburden to strengthen coverage of the goaf to ensure stability of the end slope of the strip mine; and using the dendritic reverse underground mining method to mine a second mining area and a third mining area adjacent to a first mining area, to realize continuous recovery of the thin coal seam at the end slope in sequence.

2. The dendritic reverse underground mining method for the thin coal seam at the end slope of the strip mine according to claim 1, wherein in the step S1, the main adit is inclined downward by 1-3° along the seam floor in an excavating direction.

3. The dendritic reverse underground mining method for the thin coal seam at the end slope of the strip mine according to claim 1, wherein in the step S2, each of the secondary adits is inclined upward by 1-3° in an excavating direction.

4. The dendritic reverse underground mining method for the thin coal seam at the end slope of the strip mine according to claim 1, wherein an angle between each of the secondary adits and the main adit in the step S2 is set to 45°-60°.

* * * * *